United States Patent [19]

Plack

[11] 4,103,523

[45] Aug. 1, 1978

[54] APPARATUS FOR DYEING FLOCKED TEXTILE FIBERS

[75] Inventor: Ludwig Plack, Biedenkopf, Fed. Rep. Germany

[73] Assignee: Obermaier & Cie., Neustadt an der Weinstrasse, Germany

[21] Appl. No.: 731,784

[22] Filed: Oct. 12, 1976

[30] Foreign Application Priority Data

Oct. 18, 1975 [DE] Fed. Rep. of Germany ..... 2546878

[51] Int. Cl.[2] ..... D06B 5/14

[52] U.S. Cl. ..... 68/187

[58] Field of Search ..... 68/187, 194, 184, 181 R, 68/186, 199, 43, 94, 120, 122, 129

[56] References Cited

U.S. PATENT DOCUMENTS 1,659,967 2/1928 Wood ..... 68/187 X

FOREIGN PATENT DOCUMENTS 633,363 10/1927 France ..... 68/184

87,854 8/1956 Norway ..... 67/181 R

*Primary Examiner*—Philip R. Coe

*Attorney, Agent, or Firm*—Orville N. Greene; Frank L. Durr

[57] ABSTRACT

Pressed balls of flocked textile fibers as they are received by the dyer are inserted in a water tight container having inlet and outlet means to circulate dye liquor therethrough, the pressed ball is placed over the outlet opening for the dye which is surrounded by spacer means to space the fibers of the ball from the outlet opening. Additional means are provided to hold the ball against the spacer means. In a preferred form of the apparatus, a unit comprising a plate-like means which contains the spacer means, a central opening to which an outlet pipe is connected and the means for holding the pressed ball against the spacer means, is removable from the water-tight container.

2 Claims, 4 Drawing Figures

APPARATUS FOR DYEING FLOCKED TEXTILE FIBERS

The invention concerns a process for dyeing flocked textile fibers, i.e., fibers in the still unspun state, and an apparatus for carrying out this process.

Unspun textile fibers are delivered to the dye house, as a general rule, washed and dried and in the form of pressed balls of unitary size and like weight. The dyeing in a modern plant is according to the following process: The balls are opened and the flock loosened. Then the loosened material is introduced in a holder with a sieve-like perforated wall and a carrier plate and is again pressed together uniformly, up to a density of about 300 to 400 grams per liter of packing space.

Then, this sieve-walled holder is introduced with a suitable lifting apparatus into a somewhat larger vessel in the bottom of which a circulating pump for the dyeing fluid, the so-called dye liquor, is arranged and which is closable by a water-tight cover. The dye bath is filled, the vessel closed and the dye moved through the sieve-walled holder and the fiber-material pressed therein by means of the circulating pump long enough to attain the desired coloring. After that the dyed material is taken off of the carrier plate from the dyeing apparatus, dried, again loosened and passed on for further treatment. Then, the sieve-wall holder can be taken out.

The dyeing of flocked textiles, according to this process, is very expensive, on the one hand on account of the necessary very costly and expensive dyeing apparatus besides technical accessories as pressing apparatus and lifting apparatus, on the other hand on account of the high labor expenses which arise most of all because the thread material is loosened for the dyeing apparatus and then must be pressed together again into the sieve-walled container. Then further, the dye proportion with the known apparatus is unfavorable, i.e., it requires very much dye liquor in proportion to the thread material in a filled apparatus. Further labor expense is brought on by the care required of the complicated apparatus parts.

Since the dye in the known apparatus flows through the dye goods from within to the outside and therefore arrives at a relatively large area from the to-be-dyed thread material in the reflux space between the sieve-walled holder and the inner wall of the vessel, a proportionately large amount of flock is dragged out in the apparatus. This requires a high expense for cleaning work if operating disturbances through pollution of the pump is to be prevented.

The invention, therefore, is based on the problem of providing a process and apparatus for dyeing flocked fibers that considerably decreases the labor costs as compared to the known process, which permits the employment of an essentially simple apparatus and makes superfluous a large part of the technical accessories, for example, the press.

The invention proceeds for a solution of this problem for a process by which the thread material is delivered in washed and dried state and in the form of a pressed ball. This pressed ball, according to the invention, is introduced into a vessel supplied with a circulating device for the dye, which vessel has at least one dye outlet opening against which outlet opening the pressed ball is pressed, whereby the dye is impelled through the pressed ball by means of circulating device until the desired dyeing is obtained whereafter the thread material is dried in the known way and loosened.

According to this essentially simplified process, compared to the state of technique, the labor costs for the dye results of a like amount of goods, is considerably reduced, since the thread material is not loosened before the dyeing, and need not be pressed anew. The technical expense is considerably limited because an apparatus for the pressing of the thread materials before the dyeing is dropped and the dyeing apparatus itself can be built considerably simpler. Also, the space requirement is not so large as the known process described above, by which additional space is necessary for the filling of the sieve-walled holder.

Advantageously, a dye exit or entrance opening can be fixed on two opposing sides of the pressed ball and during the dyeing process, the dye liquor withdrawn from both sides and/or the current direction of the dye liquor during the dyeing be changed.

This has the advantage that the path of the dye liquor through the pressed ball is shortened when the dye is withdrawn from two opposing sides of the balls. The interior of the ball is better penetrated when the dye is flowed in from one side of the ball and withdrawn from the opposite side. Finally, the ball is better deaerated when the flow direction of the dye liquor during the dyeing process is reversed one or more times. These three process possibilities can be carried out in any sequence successively with the same apparatus.

A further technical improvement can consist in that the dye liquor to the pressed ball be treated in vibration for the purpose of improving the deaeration. This vibration has advantageously a frequency of about 50 Hz and can as well proceed with the, or against the, flow direction of the dye as also across or from different directions to these simultaneously.

The apparatus for carrying out the process consists essentially of a water-tight closable holder connected with a circulating pump by means of tubular conduits as the circulating means for the dye liquor which holder advantageously has a rectangular cross-section, which is somewhat larger than the cross-section of the pressed ball, whereby one holder will is formed as a water-tight, closable door, in the center of a holder wall of the holder bottom, an outlet opening for the circulating device is provided, which is surrounded by a collar-like spacing ring for spacing the pressed ball from the outlet opening whereby spacing ribs are arranged extending, preferably radiating, from the dye outlet opening to the spacing ring, while opposite to the dye outlet opening of the holder range, advantageously in the opposite holder wall, an outlet opening for the circulating means is provided.

Advantageously, a device for pressing the pressed balls on the spacing ring surrounding the dye outlet opening can be provided opposite to the holder wall containing the outlet opening.

According to the invention, this pressing device comprises a water-tight slide, guided through the container wall at right angles with respect to the dye outlet opening, which carries at its inner end, a perforated lattice-like formed or star-shaped, gripping pressure plate and whose outer end is connected with a screw spindle or a lever mechanism.

In a preferred embodiment, the collar-like spacing ring with its spacing ribs radiating from the outlet opening of the dye are connected to a pipe within the vessel, the pipe providing the dye outlet opening and means for holding the pressed ball against the spacing right are all connected as a unit which is removable from the container.

Therewith, the necessity is eliminated that each ball to be dyed must first be aligned and squeezed between the spacing means of the dye outlet opening and the opposing pressure means in the container. This alignment and clamping of the balls in the container in such a way that the dye liquor has free access and escape requires a certain time for each operation by which the capacity of the apparatus is diminished. This can take place now outside the container.

The removable unit on which the pressed ball can be mounted before inserting in the container can comprise a flat, plate-like device having a central opening on which the spacing devices may be mounted and to the opening of which one end of a pipe is connected and the other end of the pipe having an opening adapted to fit over a conical ending pipe which leads to the circulating pump.

Now the invention will be further explained with the aid of the drawing showing schematically, by way of example, forms of the apparatus for carrying out the process.

Figure 1:
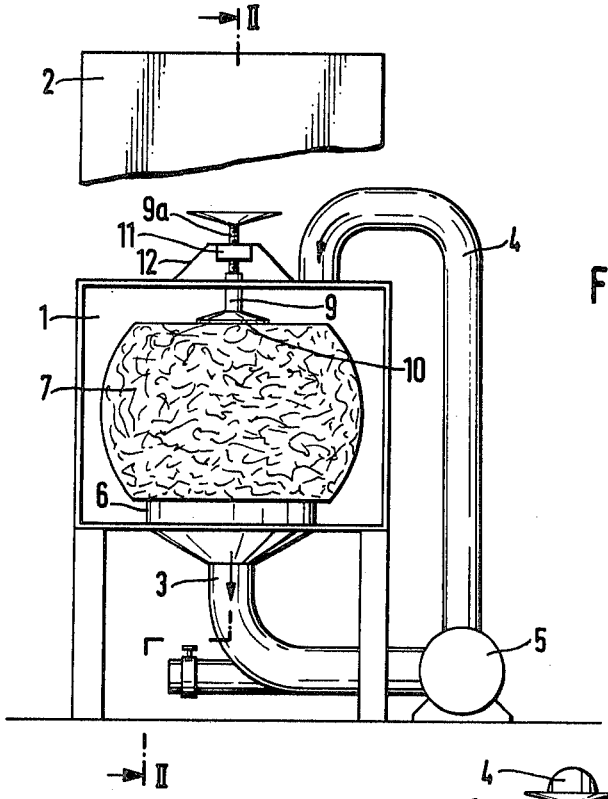
FIG. 1 is a side view of an apparatus from the door side with the door open and an inserted pressed ball.
Figure 2:
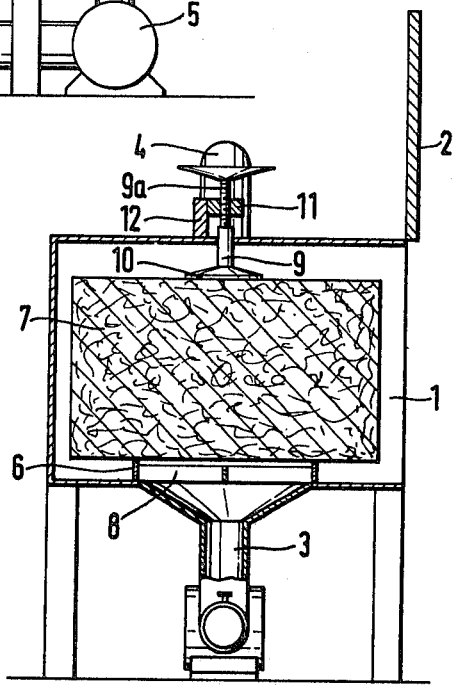
FIG. 2 is a sectional view taken on line II—II of FIG. 1.

The apparatus of the invention, according to the first embodiment shown, consists essentially in a container 1 of sheet steel, with a rectangular cross-section. One side wall of the container 1 is formed as a water-tight, closable door 2. In the middle of a side wall at right angles to the door 2, for example, the bottom of the container 1, an opening is arranged with a pipe 3 leading to the outside for the outlet of the dye liquor from the container 1. In the opposite side wall, an opening is found in which a pipe 4 for admission of dye is connected. The pipes 3 and 4 are connected to one another through a circulating pump.

Around the dye outlet opening, a collar-like spacing ring 6 is arranged, which spaces the goods to be dyed, in the form of a pressed ball 7, from the outlet opening. Between the outlet opening and the spacing ring 6 radially arranged spacing ribs 8 are provided which have an outward curvature that prevents the pressed ball 7 from lying against the outlet opening.

In the container wall opposite the dye opening, water-tight slider 9 movable toward the outlet opening is positioned on the inner end of which is perforated pressure plate 10. The outer end of the slider 9 is formed as a screw threaded spindle 9*a*, which operates in a threaded nut 11 that is held in a shield 12 at a suitable distance from the container wall. The slider 9 forms, together with the threaded spindle 9*a*, the pressure plate 10, the threaded nut 11, and the shield 12, a pressure arrangement by which the pressed ball 7 can be pressed toward the wall of container 1 which has the dye outlet opening and the spacing ring 6 and the spacing ribs 8.

A dyeing process in this apparatus is put into effect as follows: The goods to be dyed are in the form of pressed balls as delivered to the dye house. Such a pressed ball will be brought into the container with the standard equipment of the dye plant, for example a forked stapler which is equipped with gripping tongs. Then, the pressed ball is pressed against that wall of the container which has the dye outlet opening by means of a pressure device and the container door closed. After that, the dye is admitted to the container and passed through the container with the pressed ball 7 over the circulating arrangement with the circulating pump 5.

After sufficiently thorough dyeing of the pressed ball, the dye is removed from the container, the door opened, the clamping means loosened and the pressed ball 7 removed. The further treatment of the thread material is carried out in the known way.

The apparatus can also, according to another embodiment, have a container 21 in the form of an upright cylinder made of sheet steel. The bottom 22 and the cover 23 are arched, cup-shaped, whereby the upper end of the container is formed with the cover 23 as a water-tight closable access means to the container for loading with the pressed ball.

Figure 4:
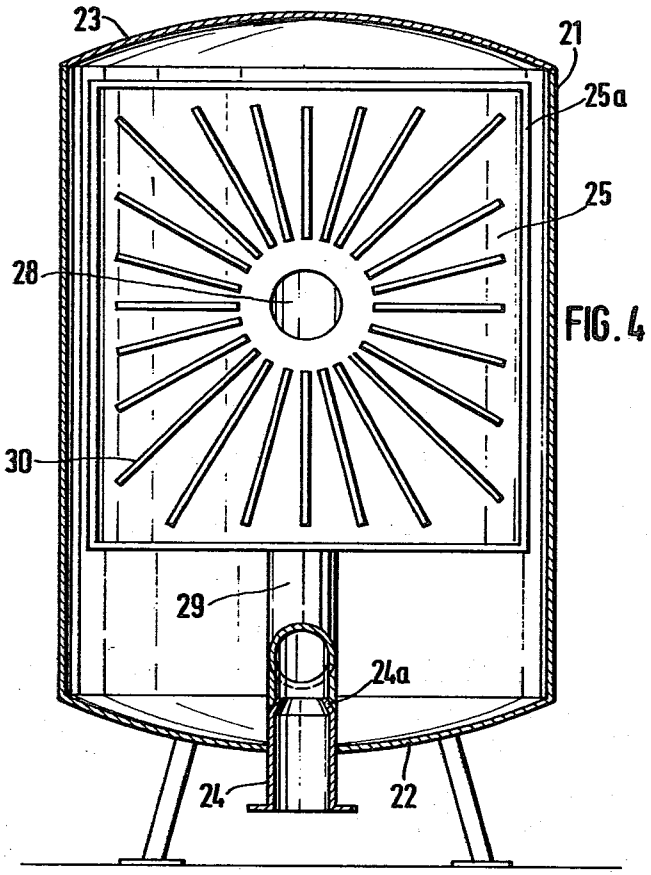
FIG. 4 is a sectional view taken on line IV—IV of FIG. 3, with a view of the dye outlet side of the pressed ball carrier.
Figure 3:
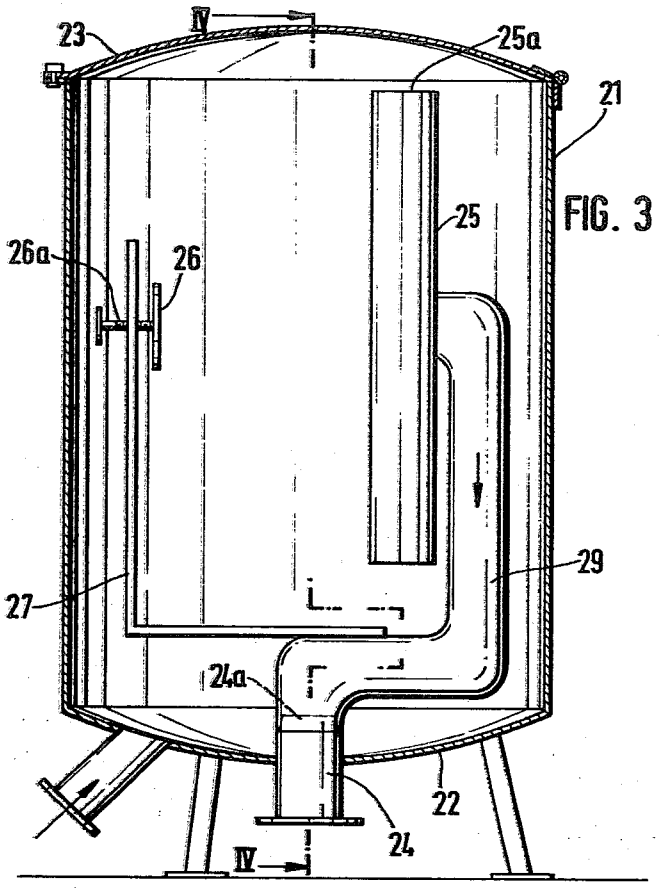
FIG. 3 is a longitudinal cross-sectional view through another embodiment of the apparatus with a pressed ball carrier in side view.

A tubular conduit 24 leads out through the bottom 22 and acts as dye liquor outflow pipe in which the end projecting into the container is formed as a cone 24. The tubular conduit 24*a* is set away in the interior of the container 21 where it leads to the dye outlet side of the ball carrier which is generally removable from the container 21. The ball carrier, in this modification, has arranged thereon, on the dye outlet side, a vertically standing flat dish 25, which is surrounded by a collar-like spacing ring 25*a* and comprises a loop 27 carrying pressure plate 26 connected with the part 25. The dish 25 has a central opening 28 (FIG. 4) for the dye liquor outlet to which the tubular conduit 29 is connected and which conduit in turn is connected to the cone 24a of the tubular conduit 24 extending through the bottom 22. In the dish 25, radiating spacing ribs are arranged which prevent the pressed ball from arching against the dye liquor outlet and closing it. The pressure plate 26 is movable toward the dish 25 through a threaded spindle 26*a* so that the pressed ball can be clamped between the dish 25 and the pressure plate 26.

The ball carrier 25,26,27 which is removable from the container 21 has not only the advantage, that the preparation work to a dyeing process has already begun while the dyeing process of the previous batch is running, but also the pressed ball can be left on the ball carrier for further treatment after dyeing, e.g., for drying, when the drying apparatus is built to suit the same.

Finally, it is possible to construct the container and the ball carrier so that several pressed balls can be inserted into the container simultaneously.

I claim:

1. In an apparatus for dyeing pressed balls of flocked textile fibers of the type comprising a water-tight container having a liquid inlet opening, a liquid outlet opening and pump means connected to the inlet and outlet openings for circulating dye liquor through the container, and one wall of the container being hinged to provide a watertight door, the improved structure for the dyeing of the pressed balls of flocked textile fibers wherein said container has a cross-section of larger size than the size of the pressed balls to be dyed and comprises pressed ball positioning means consisting essentially of a collar-like spacing ring surrounding the outlet opening, a series of radial spacing ribs extending from the outlet opening towards said spacing ring whereby a pressed ball to-be-dyed can be placed over said outlet opening without blocking the latter, and means opposite said outlet opening for holding a pressed ball to-be-dyed on the spacing ring and radiating ribs, said inlet opening being positioned to supply dye liquor to the space surrounding the pressed ball, said outlet opening for the dye liquor being contained in a plate device containing the collar-like spacing ring which also comprises internal pipe means extending inside the container from the outlet opening towards one wall of the container, connecting pipe means for the internal pipe means extending through one wall of the container, said means opposite the outlet opening for holding a pressed ball on the spacing ring being connected to said plate device.

2. The apparatus as claimed in claim 1, wherein the hinged wall of the container is at the top thereof and wherein the connecting pipe means extending through the wall of the container is in the bottom of the container and comprises means for relessably connecting to said internal pipe means whereby the ring spacer means, outlet opening, internal pipe means, and means for holding the pressed ball against the outlet can be removed from the container.

* * * * *